US005305810A

United States Patent [19]

Meshberg

[11] Patent Number: 5,305,810

[45] Date of Patent: Apr. 26, 1994

[54] APPARATUS AND METHOD FOR FILLING AND DISPENSING A HIGHLY VISCOUS PRODUCT FROM A CONTAINER

[76] Inventor: Philip Meshberg, 2770 S. Ocean Blvd., Apt. 602, Palm Beach, Fla. 33480

[21] Appl. No.: 887,032

[22] Filed: May 22, 1992

[51] Int. Cl.[5] ..... B65B 1/04; B65B 3/00

[52] U.S. Cl. ..... 141/374; 141/18; 141/113; 220/710; 222/211

[58] Field of Search ..... 141/374, 113, 2, 3, 141/20, 18; 220/710, 705–709, 366; 215/1 A; 222/209, 210, 211, 212, 213, 214, 215, 464, 493, 477, 572, 567, 569, 481, 481.5

[56] References Cited

U.S. PATENT DOCUMENTS

| | | | |
|---|---|---|---|
| 3,283,727 | 11/1966 | Rodrigues | 103/203 |
| 3,361,303 | 1/1968 | Jacuzzi et al. | 222/183 |
| 3,648,907 | 3/1972 | Marchant | 222/212 |
| 3,672,543 | 6/1972 | Roper et al. | 222/212 |
| 3,877,271 | 4/1975 | Maddock | 72/23 |
| 4,069,950 | 1/1978 | Archer | 222/210 |
| 4,327,782 | 5/1982 | McKibben et al. | 222/464 |
| 4,545,510 | 10/1985 | Mettenbrink | 222/209 |
| 4,625,897 | 12/1986 | Wortley | 222/205 |
| 4,634,028 | 1/1987 | de Larosiere | 222/464 |
| 4,750,647 | 6/1988 | Cohen | 222/386.5 |
| 4,781,313 | 11/1988 | Verheyen | 222/464 |
| 4,865,224 | 9/1989 | Streck | 222/213 |
| 4,981,238 | 1/1991 | Wenmaekers | 222/103 |

FOREIGN PATENT DOCUMENTS

| | | |
|---|---|---|
| 0193054 | 9/1986 | European Pat. Off. . |
| 0473994 | 3/1992 | European Pat. Off. . |
| 0499538 | 8/1992 | European Pat. Off. . |
| 2710984 | 9/1978 | Fed. Rep. of Germany . |
| 2655315 | 6/1991 | France . |
| 8202034 | 6/1982 | PCT Int'l Appl. . |

*Primary Examiner*—Henry J. Recla
*Assistant Examiner*—Steven O. Douglas
*Attorney, Agent, or Firm*—Kenyon & Kenyon

[57] ABSTRACT

A method and apparatus for filling of a dispensing container with a product to be dispensed, particularly useful for highly viscous products, in which the container has a vented dip tube structure which is inserted into the container before it is filled. Filling is accomplished by inserting a filling nozzle into the container so that it cooperates with the top of the dip tube. Filling of the container therefore occurs through the dip tube. The vent in the dip tube structure allows the air in the container to be vented as the container is filled. Because the container is filled through the dip tube, the product completely fills the dip tube at the time when the pump structure is inserted into the container. The vent structure can be used as a vent for the container during a dispensing operation as well.

21 Claims, 6 Drawing Sheets

APPARATUS AND METHOD FOR FILLING AND DISPENSING A HIGHLY VISCOUS PRODUCT FROM A CONTAINER

BACKGROUND OF THE INVENTION

The present invention relates to the dispensing of products from a container using an attached pump, and more particularly to an apparatus and method for allowing a dispensing device to be advantageously used for highly viscous products.

Container-mounted pumps are often used for the dispensing of liquid home-care or personal products from a container or bottle. Generally, the pump is supplied with a syphon or "dip" tube which has been attached to the pump during assembly of the pump, and which is of a relatively narrow diameter. In this arrangement, the container or bottle is first filled with the product to be dispensed, and then the pump/dip tube combination is inserted into the filled container and attached to the bottleneck. This filling and assembly procedure leaves a column of air within the dip tube and in the pump. The column of air occurs because the dip tube is inserted into the liquid from above, and the air has no means for escaping from the dip tube during insertion, the pump inlet and/or outlet valves being normally sealed.

The column of air in the dip tube must be removed from the dip tube and pump before the product can be dispensed. The pump therefore must be "primed" by a user before any product will come out of the pump nozzle. Priming is the procedure whereby the actuator is pushed in one or more times to clear trapped air from the pump and dip tube and to draw product up the dip tube, into the pump, and out the nozzle.

The process of priming is relatively simple when the product to be dispensed is of low viscosity, as with most personal and home-care products. However, certain cosmetic products, such as makeup, are highly viscous. The high viscosity of these products makes the priming of a pump filled in the above-described conventional manner extremely difficult and time-consuming. This is because of the high viscosity of the product makes it necessary for a substantial force to pull the product up the entire length of the dip tube. Even when a dip tube of relatively large diameter is used, it may take more than 35 actuations of the actuator to prime the pump. For a consumer, this result is very undesirable. To prevent this result additional steps can be taken during the packaging operation. One method for preventing additional priming is to place a vacuum onto the pump after it has been attached to the container, thereby drawing the product up the dip tube. This procedure requires the additional assembly and disassembly steps of removing and replacing the actuator, as well as the need for opening the normally closed inlet and/or outlet valves. These additional steps can be expensive and time consuming, and can add to the cost of packaging the product.

The present invention is directed to a method and apparatus for solving the above problems. The present method and apparatus are particularly useful in that they do not require disassembly and reassembly of the pump structure during the filling process, unlike the procedure mentioned above using vacuum priming. The present invention therefore is much more economical and efficient than this method, and still provides the same advantages in terms of priming.

DETAILED DESCRIPTION

Figure 1:
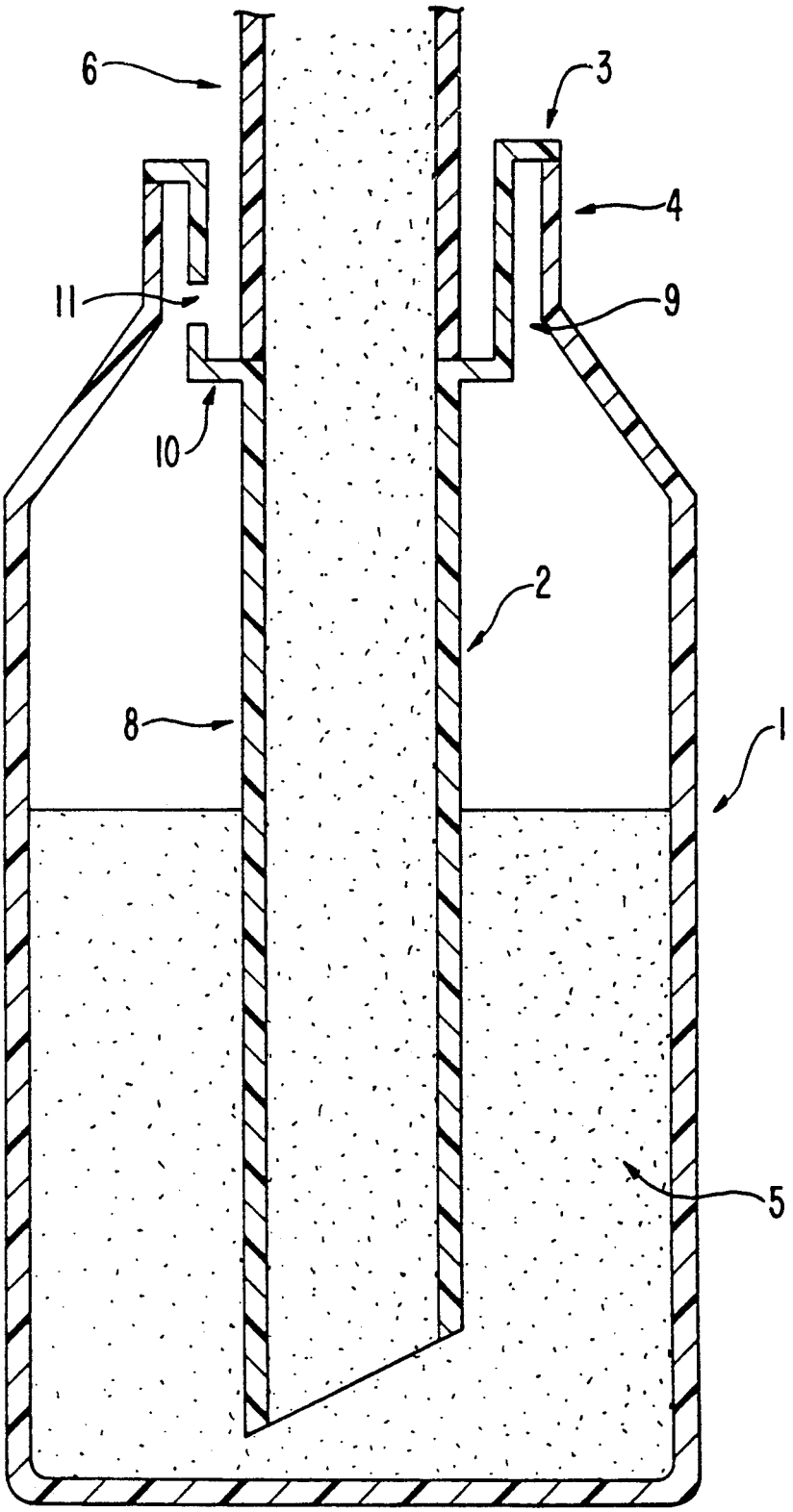
FIG. 1 shows a first embodiment of the present invention during a filling operation.

FIG. 1 represents the present invention during a filling operation. A container or bottle 1 of any conventional type used for holding a product to be dispensed has inserted therein a syphon or dip tube structure 2. The dip tube structure 2 can be a separately formed, as shown in FIG. 1, or could be integrally molded with container 1. Dip tube structure 2 has a radially-extending flange 3 which cooperates with the neck 4 of container 1 to seat dip tube structure 2 in container 1. Dip tube structure 2 also has a dip tube 8 and an upper portion 9. Dip tube structure 2 is inserted into container 1 before container 1 is filled with product 5.

After insertion of dip tube structure 2 into container 1, container 1 is filled with a product 5 to be dispensed from container 1. Filling is accomplished by inserting a filling nozzle 6 into the upper portion 9 of dip tube structure 2. The bottom of filling nozzle 6 cooperates with a flange 10 on upper portion 9. Product 5 is then pumped or forced out filling nozzle 6, down dip tube 8, and into container 1. Upper portion 9 has a vent path 11. As product 5 flows into container 1, the air in the container which it displaces is pushed up to the top of the container 1 and out vent path 11. Filling of product 5 into container 1 is continued until the quantity of product 5 in container 1 reaches a desirable level, generally when product 5 reaches the level of the flange 10.

Figure 2:
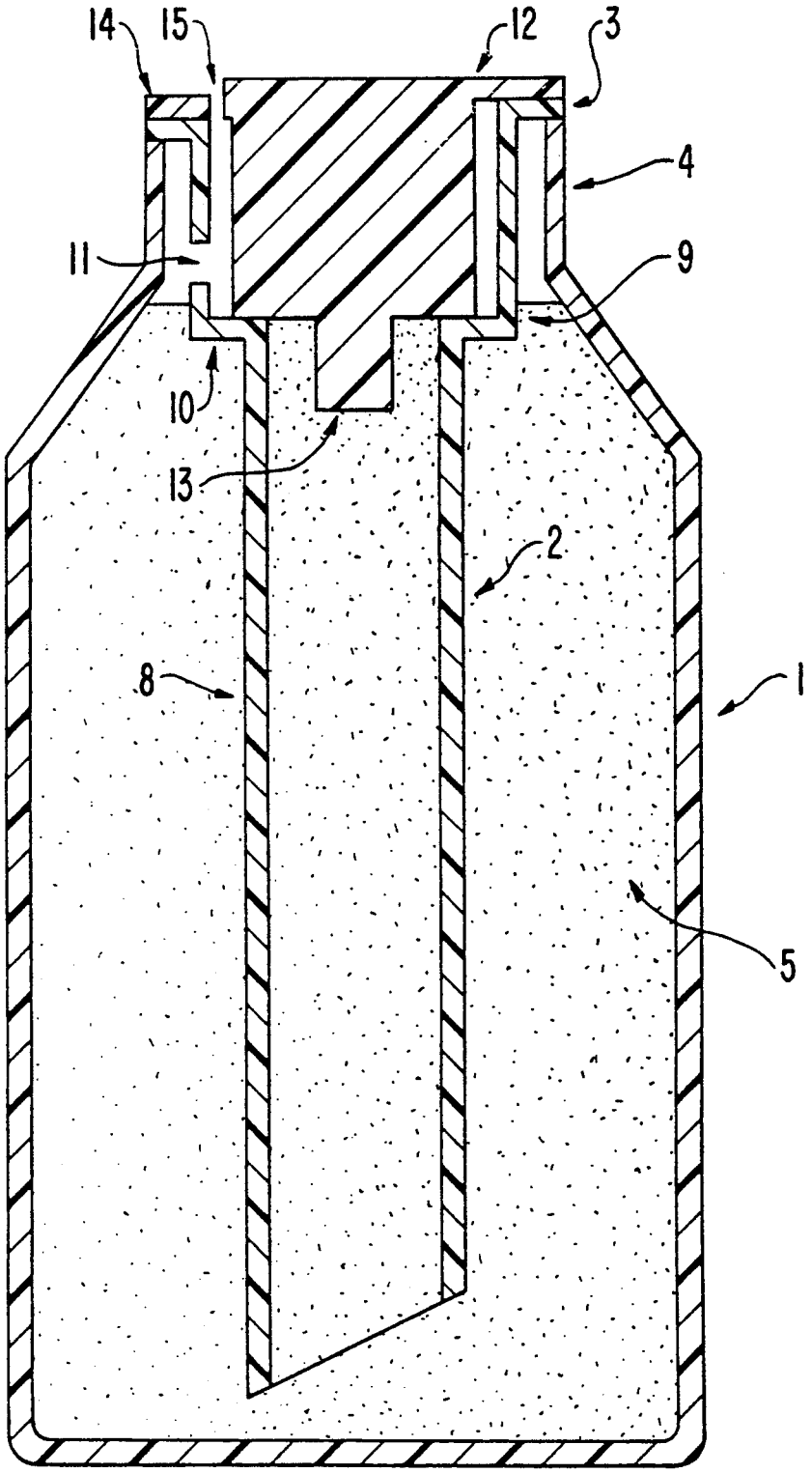
FIG. 2 shows the first embodiment of the present invention after a filling operation, with the pump mounted to the container.

FIG. 2 represents the apparatus of the present invention after filling has been completed, and immediately after insertion of a pump 12 (shown schematically in FIG. 2). The internal structure of pump 12 can be of any type known to those skilled in the art for dispensing product from a container. As can be seen in FIG. 2, because of the manner in which container 1 was filled according to the description above, the product has filled the interior of the dip tube 8 all the way up to the flange 10. Therefore, when pump 12 is inserted into upper portion 9, as shown in FIG. 2, there is no air in dip tube 8. The lower inlet 13 of pump 12 is inserted directly into product 5. Priming the pump requires only drawing the product 5 through inlet 13 and into pump 12. This arrangement makes priming of pump 12 much easier, since only the air in pump 12 must be evacuated, and there is no air in dip tube 8 which must be drawn up and out of the nozzle. To aid in the filling and priming of the pump-container combination when highly viscous products are used, it is advantageous to make the dip tube 8 of a relatively large diameter.

As shown in FIG. 2, pump 12 has an upper flange 14 which may cooperate with the flange 3 and neck 4 to secure the pump 12 to the container 1. Flange 14 can have a vent path 15. Vent paths 11 and 15 cooperate to allow venting of the container during dispensing operations, i.e., during operation of pump 12. Thus, as product 5 is drawn out of container 1 by the action of pump 12, air will travel through vent paths 11 and 15 to fill the resulting space in container 1.

Figure 3:
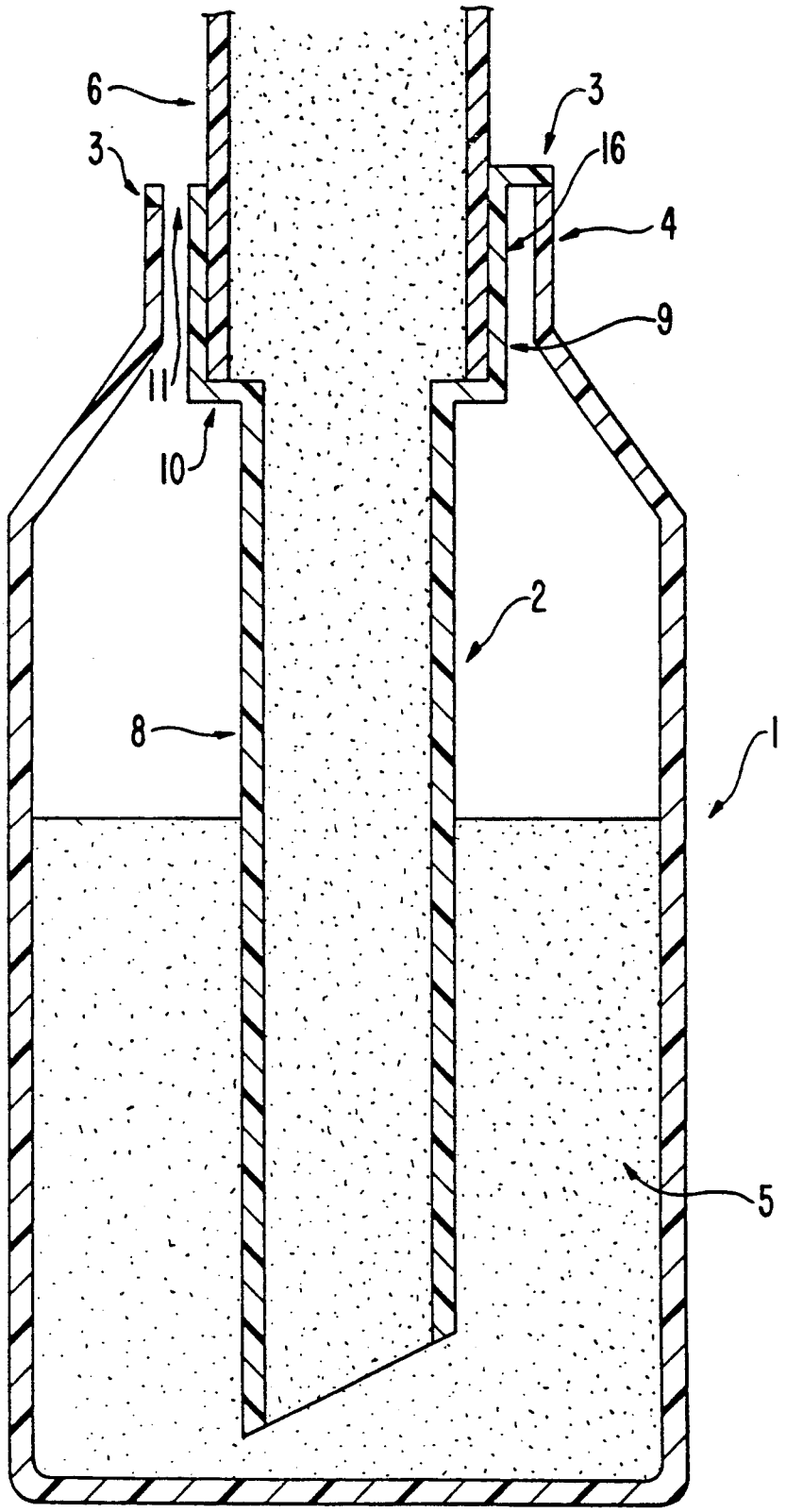
FIG. 3 shows a second embodiment of the present invention during a filling operation.
Figure 4:
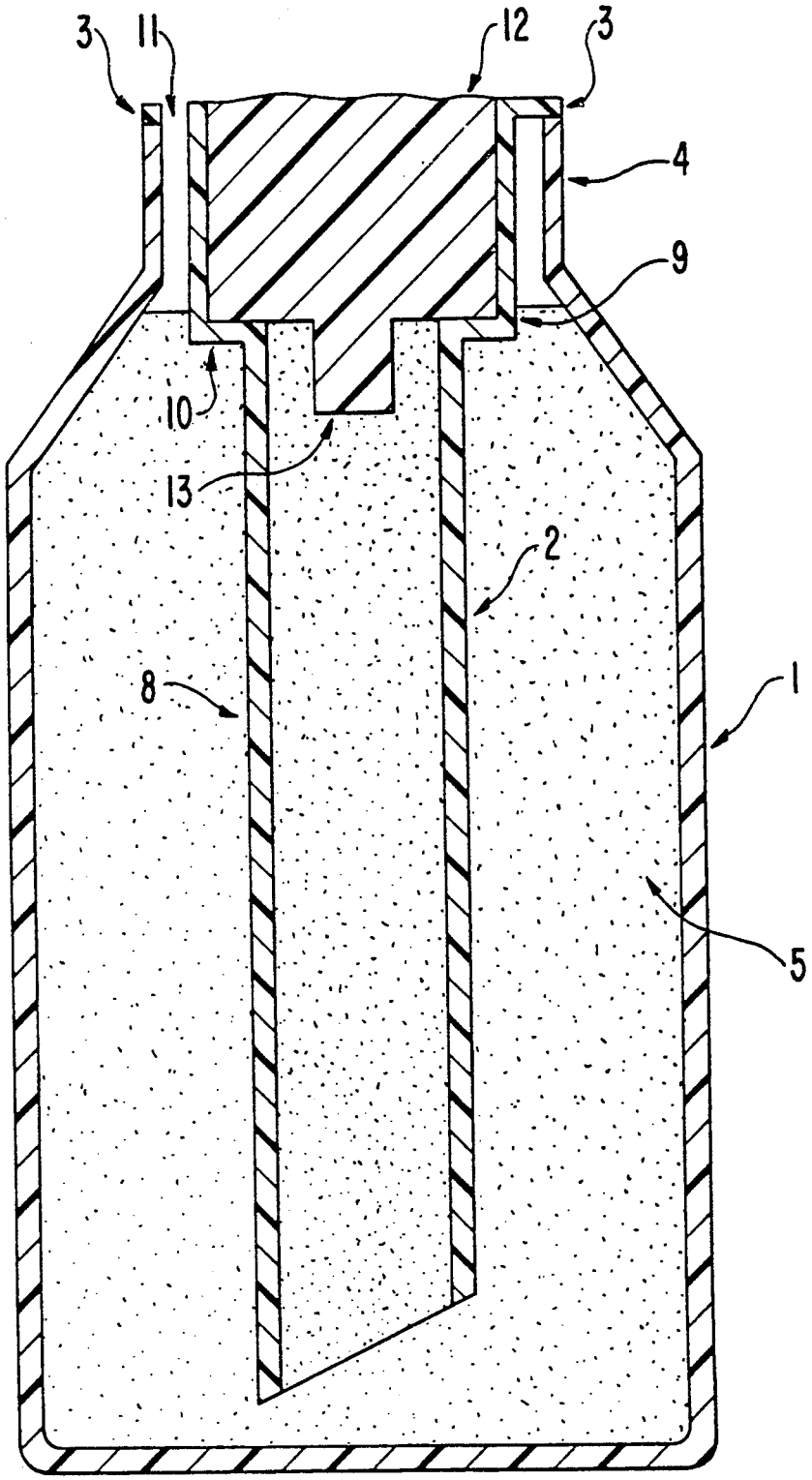
FIG. 4 shows the second embodiment of the present invention after a filling operation, with the pump mounted to the container.

FIG. 3 shows an alternative embodiment where the vent path 11 is located on flange 3. This embodiment allows the filling nozzle to cooperate with both the flange 10 and sidewalls 16 of upper portion 9. FIG. 4 shows this embodiment with the pump 12 inserted. As can be seen in FIG. 4, this embodiment allows the pump 12 body to cooperate with the flange 10 as well as sidewalls 16. There is therefore no need for an engaging flange on pump 12. Venting of the container during a dispensing operation can occur directly through vent path 11.

Figure 5:
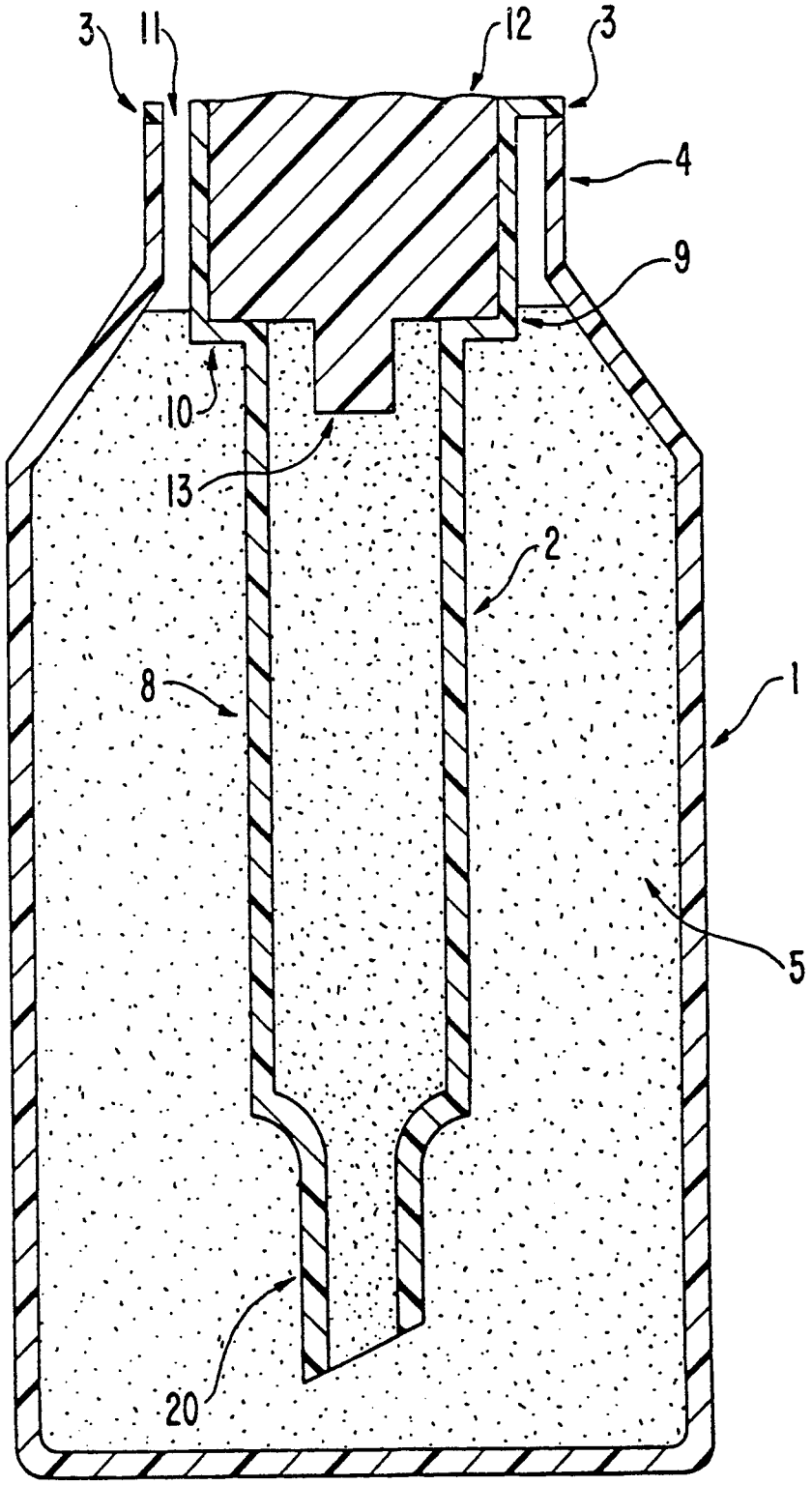
FIG. 5 shows a first alternative configuration of the dip tube in the present invention.

FIG. 5 demonstrates that the dip tube 8 of the present invention need not be straight-sided as shown in FIGS. 1–4. Dip tube 8 may have a narrowed portion 20, or alternatively a series of stepped portions gradually increasing in diameter. The size and shape of dip tube can be designed to be particularly effective for the degree of viscosity of the product to be dispensed. Stepping of the dip tube 8 allows the portion of product left in the dip tube after the container is empty to be reduced.

Figure 6:
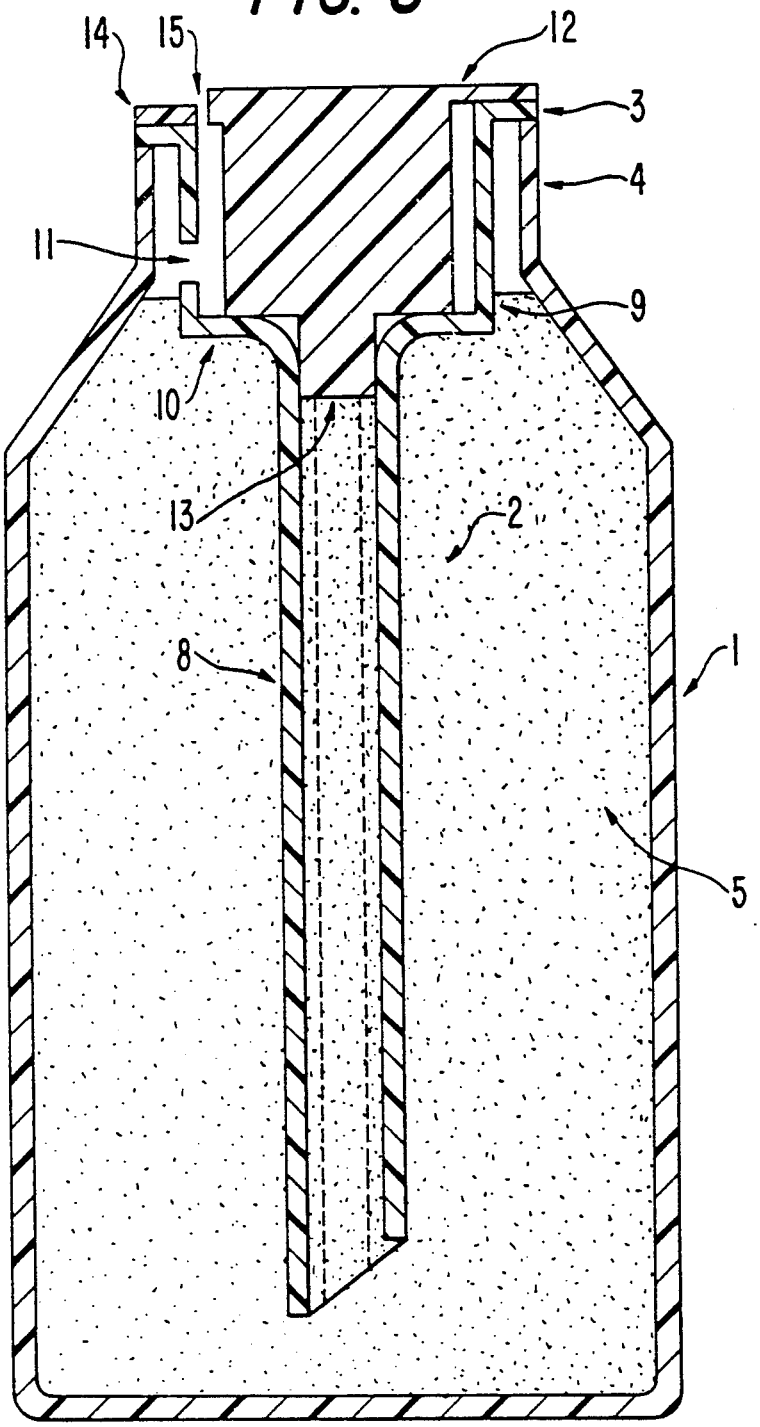
FIG. 6 shows a second alternative configuration of the dip tube in the present invention.
Figure 8:
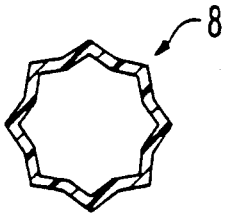
FIG. 8 shows a cross-sectional view of the dip tube of the second alternative configuration, during the filling process.
Figure 7:
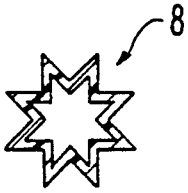
FIG. 7 shows a cross-sectional view of the dip tube of the second alternative configuration, after the pump is mounted to the container.

FIGS. 6–7 show an alternative design of the dip tube in the present invention. FIGS. 7 and 8 are cross-sectional views of the dip tube in this alternative design. As can be seen from these figures, the dip tube is corrugated along its length. The dip tube is constructed of a resilient material so that it is normally in the configuration shown in FIG. 7. FIG. 8 represents the dip tube configuration during a filling process. Thus, when filling nozzle 6 is inserted into upper portion 9 and product is pumped or forced out of filling nozzle 6, the pressure of the product pushes the walls of dip tube 8 outwardly so that the dip tube assumes the configuration shown in FIG. 8. The increase in size of the diameter of the dip tube 8 allows filling of the container 1 to proceed rapidly. After filling is completed, the resiliency of the dip tube 8 causes the corrugations to collapse to the configuration of FIG. 7. This configuration allows the volume of the dip tube 8 to be reduced. Reducing the volume of the dip tube 8 ensures that there is a relatively small volume of product left over in the dip tube after all of the product 5 has been evacuated from the container 1 during a dispensing operation. Although FIG. 6 shows the corrugated dip tube structure used with the upper portion structure of FIGS. 1–2, this dip tube structure could be used equally well with the upper portion structure of FIGS. 3–4.

One technique which can be used to assist in the filling of the apparatus of the present invention is to apply a vacuum to vent 11, thereby drawing out excess air in container 1 and assisting in drawing product 5 from filling nozzle 6 into container 1. This use of a vacuum is easily accomplished during a filling operation, and does not require disassembly of any of the parts of the apparatus, unlike the circumstance where the product must be drawn up a dip tube by the application of a vacuum to the pump.

What is claimed is:

1. An apparatus for dispensing a flowable product comprising:

a container for holding said flowable product; and a dip tube structure, said dip tube structure comprising:

a dip tube extending axially inwardly into said container; and an upper portion, said upper portion directly engaging said container, an axially outward end of said dip tube being connected to said upper portion, said upper portion having a vent path, said vent path allowing air to enter and exit said container during a filling and dispensing operation, an axial end of said upper portion opposite said dip tube being open, whereby said axial end opposite said dip tube provides an unobstructed path to said dip tube, and whereby a lower inlet of a pump may be inserted into said dip tube.

2. The apparatus of claim 1, wherein:

said upper portion is adapted to engage a filling nozzle to allow said product to fill said container via said dip tube.

3. The apparatus of claim 1, wherein:

said upper portion engages said container via a circumferential flange, said vent path passing through said circumferential flange.

4. The apparatus of claim 3, further comprising: a pump structure mounted on said container, said pump structure comprising a circumferential flange, said circumferential flange on said pump structure engaging said circumferential flange on said upper portion, said pump structure further comprising a lower inlet, said lower inlet being inserted into said dip tube.

5. The apparatus of claim 4, further comprising:

a second vent path passing through said circumferential flange on said pump structure, said second vent path being aligned with said vent path.

6. The apparatus of claim 1, wherein:

said upper portion comprises an axially-inwardly extending sidewall, said vent path passing through said sidewall.

7. The apparatus of claim 6, further comprising: a pump structure mounted on said container, said pump structure engaging said axially-inwardly extending sidewall, said pump structure further comprising a lower inlet, said lower inlet being inserted into said dip tube.

8. The apparatus of claim 1, further comprising: a pump structure mounted on said container, said pump structure having an inlet end inserted in an axially outward end of said dip tube.

9. The apparatus of claim 8, wherein:

said upper portion comprises an axially-inwardly extending sidewall, said pump structure engaging said sidewall.

10. The apparatus of claim 8, wherein:

said upper portion comprises a circumferential flange, said pump structure engaging said flange.

11. The apparatus of claim 1, wherein:

said dip tube structure is integrally formed with said container.

12. The apparatus of claim 1, wherein:

the diameter of said dip tube varies along said dip tube's axial length.

13. The apparatus of claim 1, wherein:

the dip tube is corrugated.

14. The apparatus of claim 13, wherein:

the dip tube is formed of a resilient material so that it normally biased into a collapsed condition.

15. An apparatus for filling and dispensing from a container comprising:

a tubular section; and an upper section, said upper section being connected to said tubular section at an end of said tubular section, said upper section having an unobstructed passage connecting an interior of said tubular section with an exterior of said upper section, an axial end of said upper section opposite said tubular section being open, whereby said axial end opposite said tubular section provides an unobstructed path to said tubular section, and whereby a lower inlet of a pump may be inserted into said tubular section, said upper section further comprising:

a first flange adapted to engage an outlet of a container;

a vent path; and a second flange adapted to engage a filling nozzle inserted into said upper section.

16. The apparatus of claim 15, wherein:

said tubular section is corrugated.

17. The apparatus of claim 16, wherein:

the dip tube is formed of a resilient material so that it normally biased into a collapsed condition.

18. The apparatus of claim 16, wherein:

said upper section further comprises an axially extending sidewall, said vent path passing through said sidewall.

19. The apparatus of claim 15, wherein:

said vent path passes through said first flange.

20. The apparatus of claim 15, wherein:

the upper section is further adapted to engage a pump structure.

21. The apparatus of claim 15, wherein:

the diameter of said tubular section varies along said tubular section's axial length.

* * * * *